US007073676B1

(12) United States Patent
Town

(10) Patent No.: US 7,073,676 B1
(45) Date of Patent: Jul. 11, 2006

(54) CONTAINMENT BAG SYSTEM FOR USE IN A COMMERCIAL DISPOSAL CONTAINER

(75) Inventor: Troy Town, Clinton, LA (US)

(73) Assignee: PacTec, Inc., Clinton, LA (US)

( * ) Notice: Subject to any disclaimer, the term of this patent is extended or adjusted under 35 U.S.C. 154(b) by 477 days.

(21) Appl. No.: 10/393,552

(22) Filed: Mar. 21, 2003

Related U.S. Application Data

(63) Continuation of application No. 09/930,408, filed on Aug. 15, 2001, now abandoned.

(51) Int. Cl.
*B65D 90/04* (2006.01)

(52) U.S. Cl. ..... 220/1.6

(58) Field of Classification Search ..... None
See application file for complete search history.

(56) References Cited

U.S. PATENT DOCUMENTS 4,817,824 A * 4/1989 LaFleur et al. ..... 222/105
6,079,934 A * 6/2000 Beale ..... 414/607
6,250,488 B1 * 6/2001 Narahara et al. ..... 220/1.6

* cited by examiner

*Primary Examiner*—Stephen Castellano
(74) *Attorney, Agent, or Firm*—Jones, Walker, Waechter, Poitevent, Carrere & Denegre, L.L.P.

(57) ABSTRACT

The invention consists of non-self supporting containment bag used in conjunction with a dumpster container. The bag has a zipper or other sealable means, and a series of pick-up or attachment loops or handles may also be attached to the outer bag material. The bag may additionally have an internal lining to resist leakage of fluids or wet materials stored in the container.

19 Claims, 6 Drawing Sheets

CONTAINMENT BAG SYSTEM FOR USE IN A COMMERCIAL DISPOSAL CONTAINER

This is a continuation of Ser. No. 09/930,408, filed on Aug. 15, 2001, now abandoned to which this application claims priority and which is hereby incorporated by reference in its entirety.

FIELD OF THE INVENTION

This invention relates to containment bags used with large dumpster style disposal containers in the storage, transportation and disposal of wastes.

PRIOR ART

In plant renovations or other type of construction or clean-up projects, wastes are generated and stored in large on-site dumpster-containers, such as rolloff containers, end dump containers, and gondola rail car containers. When hazardous materials (such as tank cleaning sludge, wet or dry waste materials, chemical plant by-products, rail wastes, high heat wastes), odorous materials, or fine particulate matter (for instance, incinerator ashes, powders, asbestos materials) are to be stored in an onsite dumpster container for later transportation and disposal, it is desirable to line the container to protect the container from exposure to the materials and to make later disposal easier. Currently, either large sheets of plastic are used to line the container or container bags are utilized. The existing container bags have openings that are closable using a series of ties or cords. Given the large size of the containers, closing the series of ties can be a time consuming chore. Further, the ties fail to make an effective seal.

SUMMARY OF THE INVENTION

The invention consists of non-self supporting containment bag used in conjunction with a dumpster container. The bag has a zipper or other sealable means and a series of pick-up or attachment loops or handles may also be attached to the outer bag material. The bag may additionally have an internal lining.

OBJECTS OF THE INVENTION

It is an object of the invention to provide a simple easily installable liner for a dumpster container that is sealable.

It is another object to provide a liner for use in a dumpster container having attachment or pick-up handles.

It is another object of the invention to provide a containment bag for use in a dumpster container having a secondary liner on the interior of the containment bag.

DETAILED DESCRIPTION OF THE INVENTION

Figure 1:
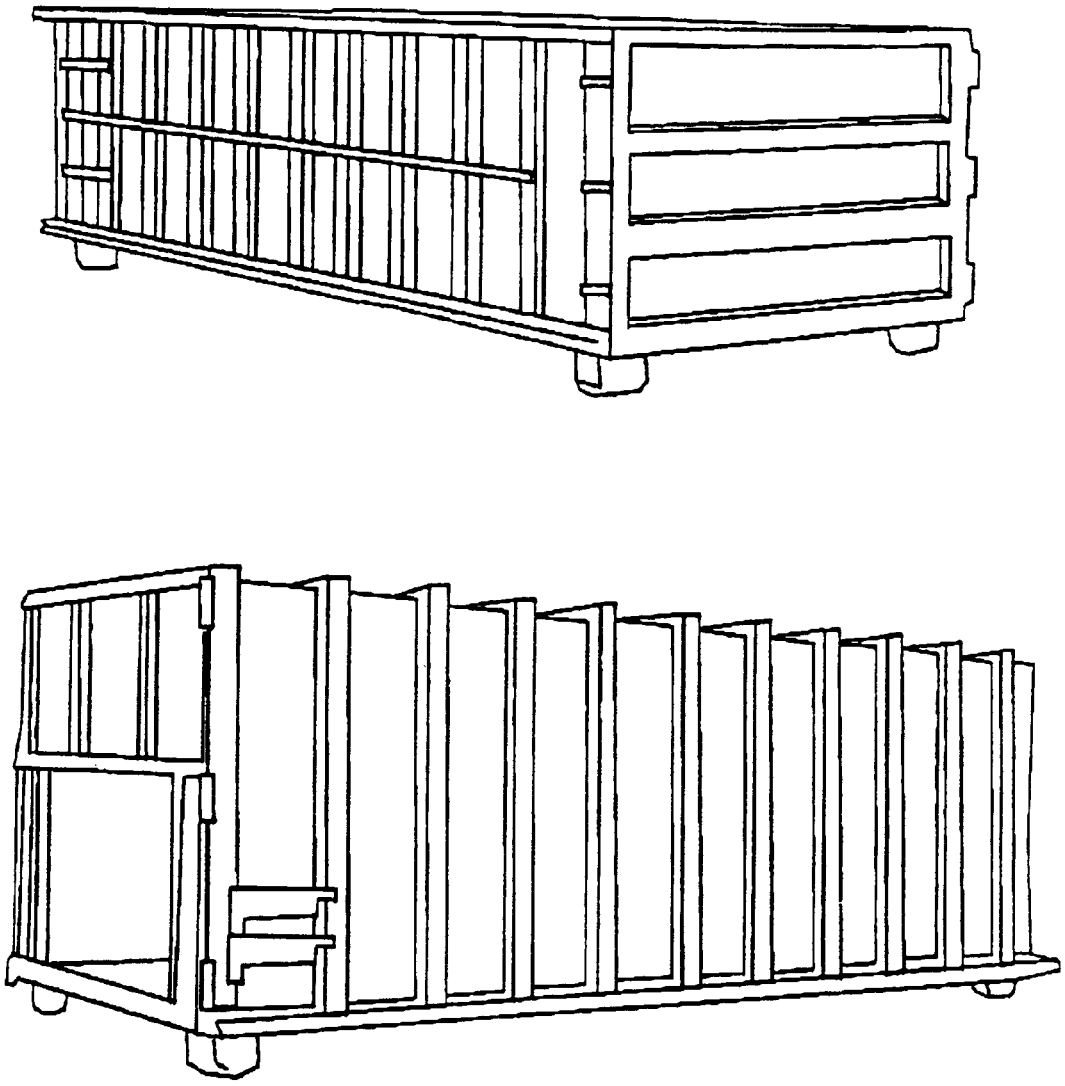
FIG. 1 is a perspective view of a rolloff container.
Figure 2:
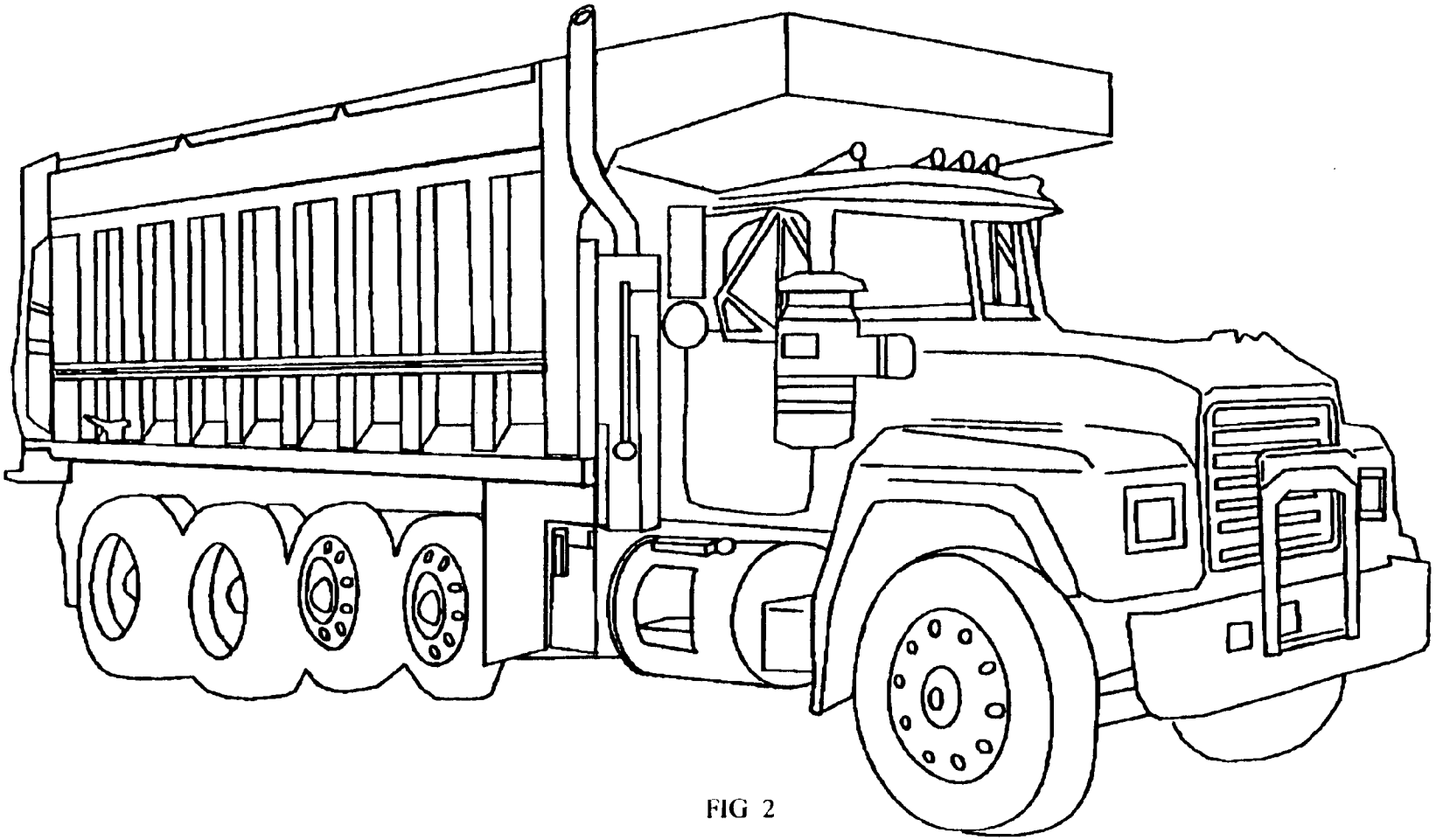
FIG. 2 is a perspective view of an end dump container.
Figure 3:
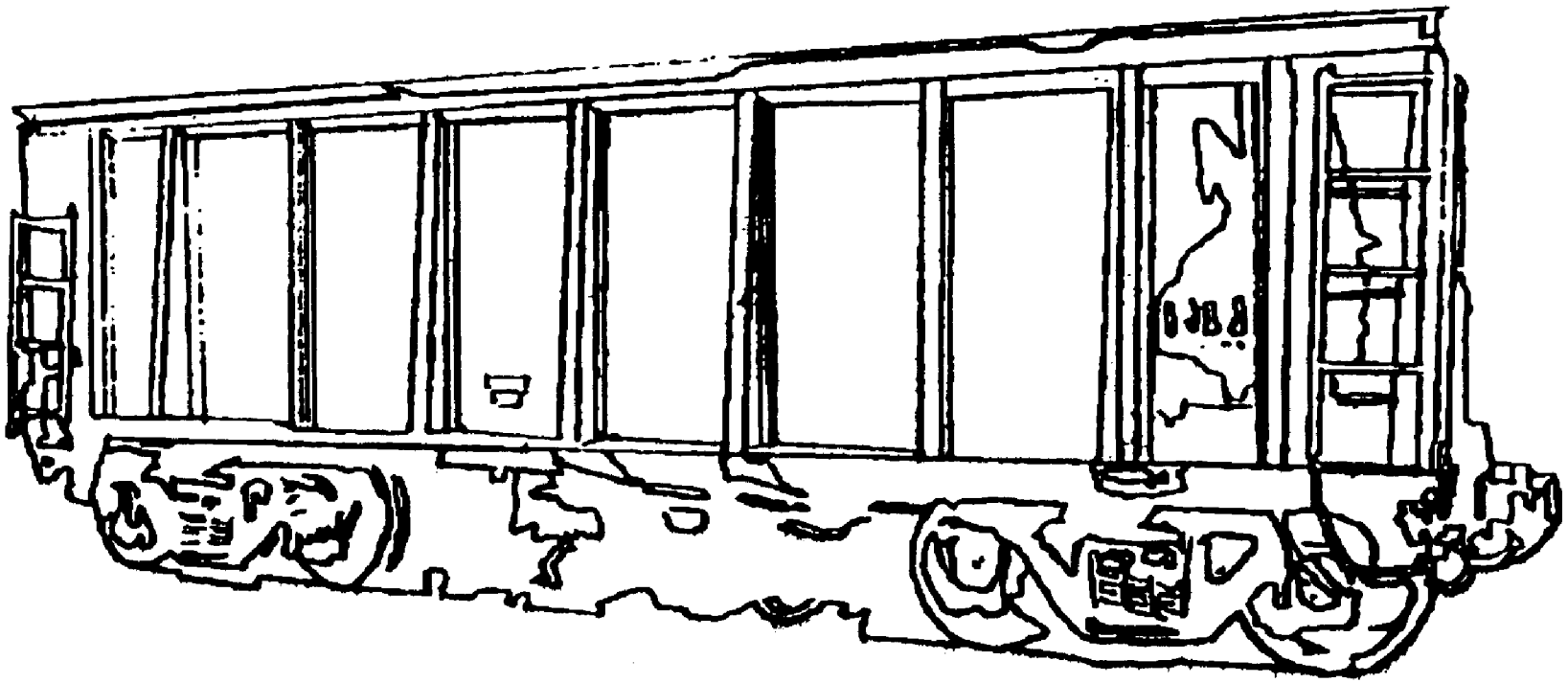
FIG. 3 is a perspective view of a gondola rail car container.
Figure 4:
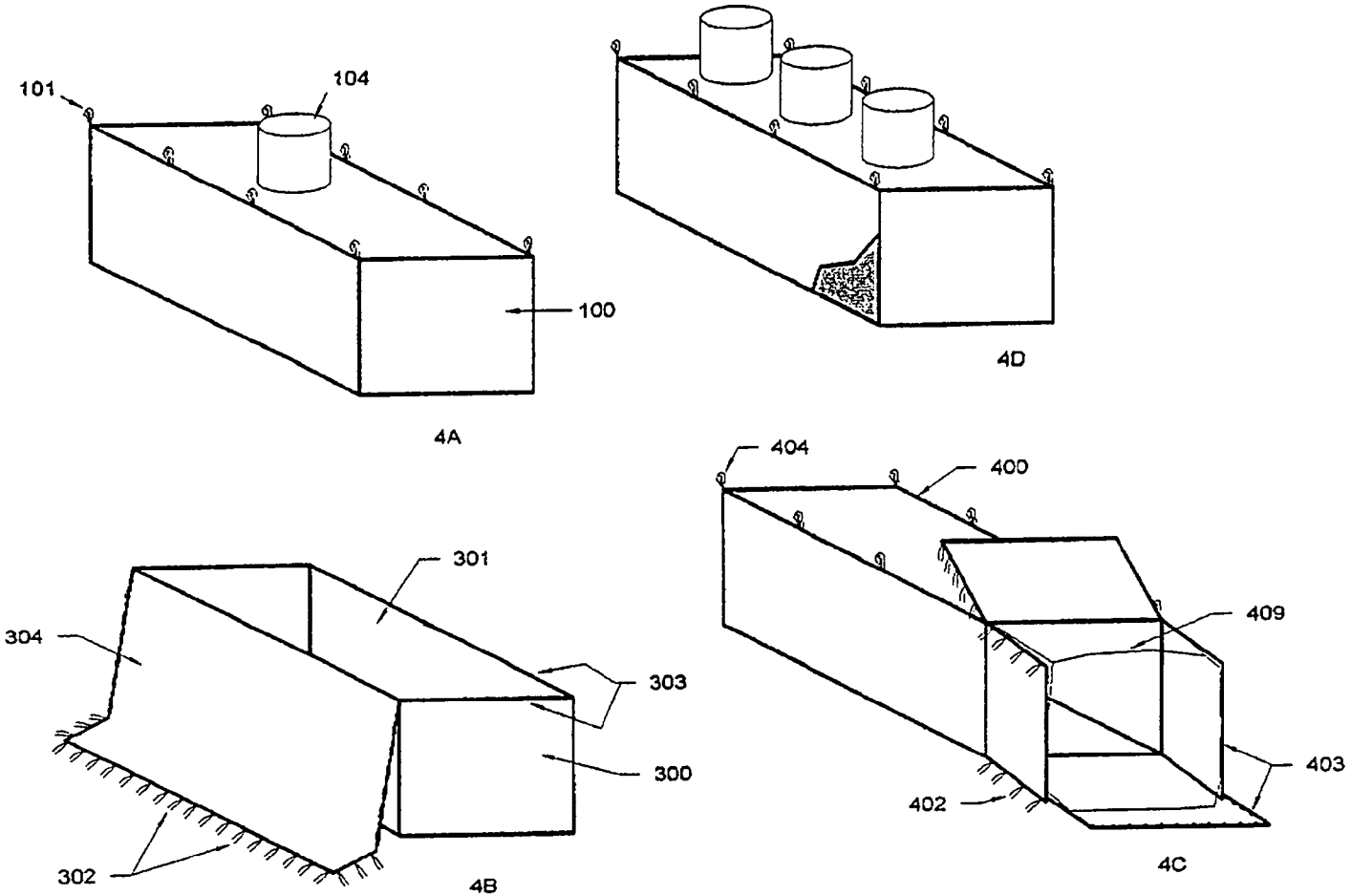
FIG 4 Prior Art
FIG. 4 shows a series of prior art container bags.

Three existing dumpster type containers are shown in FIGS. 1–3: a roll off container (FIG. 1), an end-dump container (FIG. 2) and a rail car gondola (FIG. 3). These containers range in size from 52'×10'×5' for a rail gondola to 22'×7.5'×5' for a 30 yard rolloff container. Shown in FIG. 4 are typical prior art container bags. FIG. 4*a* shows a single spout container bag 100 having a series of grab loops 101. The grab loops 101 are used to attach and support the container bag to a dumpster container. The single spout 104 provides access to the interior of the bag for loading materials into the container bag. After loading, the single spout would be tied shut with a suitable tie, such as a rope. The spout type bag can come with multiple spout configurations as shown in FIG. 4*d*.

FIG. 4*b* shows a prior art cigar top bag 300. The cigar top bag 300 has a top opening 301, which is closable by a cover 304 having a series of ties 302 located around the periphery of the top opening 301. Ties 302 attach to loops 303. FIG. 4*c* shows a prior art bread bag style container bag 400. The bread bag style is similar to the cigar top bag except the opening in the cigar top bag is located on the end instead of the top. Again, the opening is closable by tying a series of ties 402 to a matching series of loops 403. Also shown is a series of handles, shown here shown as loops 404, for attaching and supporting the container bag to a disposal container. Prior art bags are generally constructed of polypropylene and may have an interior lining 409, such as a polyethylene barrier attached to the interior of the bag shell.

Figure 5:
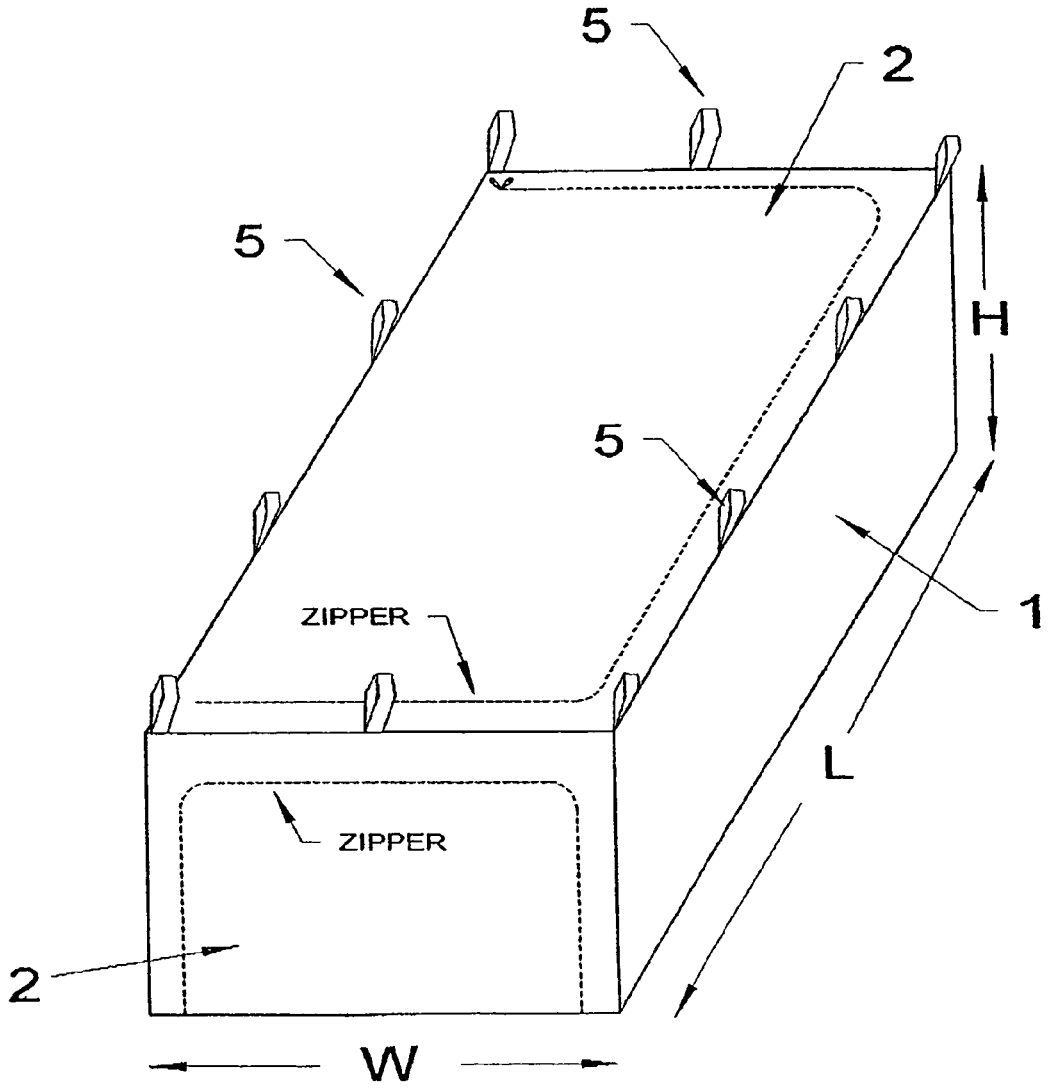
FIG. 5 is a perspective view of the containment bag invention.

Shown in FIG. 5 is containment bag 1. Containment bag 1 is made of a non-self supporting material and is designed to be inserted in a commercial dumpster container. The containment bag 1 may be made of woven or non-woven materials with a 3–5 oz woven polypropylene preferred. Other materials such as polyvinyl chloride (PVC, reinforced or non-reinforced), woven or non-woven polyethylene or other suitable materials, such as woven fiberglass may be used. The bag material may also be coated, such as woven polypropylene bag having a polyethylene coating placed on the interior or exterior of the bag.

The bag should have an opening 2 that is sealingly closable. Bag opening 2 should be placed on the bag for ease of loading and storage of materials and, in some instances, for ease of removal of the stored materials. For instance, the bag shown in FIG. 5 has two sealable openings, one positioned on the top of the bag 3, and one positioned on the side of the bag 4. The two openings are shown for demonstration purposes. In the standard embodiment, a container bag will have a single opening. As shown, the openings are closable with a sealable closing means, such as a zipper. A preferred zipper is a #10 coil nylon zipper, with two pulls positioned on the zipper tracks. Other zipper or zipper types can be used.

Also shown are support handles 5. The support handles 5 can serve two purposes: (1) to attach the bag to the container, and thereby support the bag for fill; and, in some instances, (2) to assist in moving or removal of the bag from the container. Handles 5 can be loops, such as double D-ring straps or 2-inch loops, or lines or ties, and can be made from suitable materials, such as polypropylene or polyester webbing. When used to attach the bag to the container, the handles will attach to points on the container, generally, at least one handle on each corner (see FIGS. 1 and 2 showing containers having a fabric top attached to the container with handles).

Additionally, the bag 1 may incorporate a separate inner liner 10 (not shown). Inner liners are useful when the stored materials are wet or liquids. Suitable material can be low-density polyethylene, with 6–10 mil thickness being preferred. One such liner is disclosed in U.S. Pat. No. 5,110,005, herein incorporated by reference. Inner liner may be sewn to the outer bag, or attached by other means, for instance heat-sealed to the outer bag.

The container bag as shown is intended to be disposed with the stored wastes, and not intended to for re-use.

Figure 6:
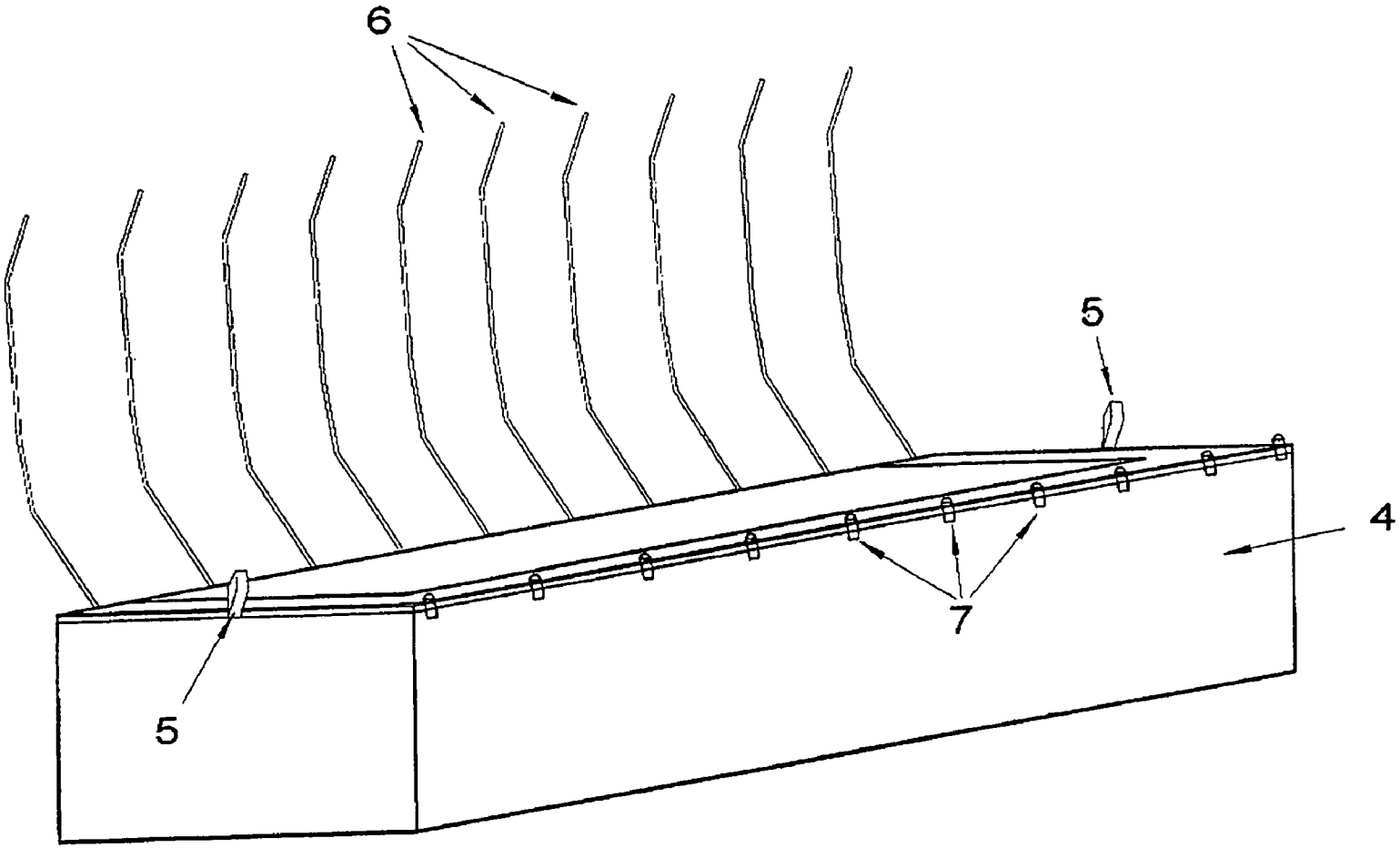
FIG. 6 is a perspective view of another embodiment of the containment bag invention.

Shown in FIG. 6 is another embodiment of the container bag 4. Bag 4 is shown having a single top opening, sealable with a zipper. Also shown are loops 5 on one side of the top and a series of straps 6 on the opposite topside. As shown, the matching loops are D-ring loops 7. The straps are of length sufficient to cross the top surface of the bag and tie into loops on the opposite top side. When so secured, these straps help resist "flapping" of the bag top during transport in an open container, such as a railcar gondola.

It is intended that the following claims be interpreted as covering all such alterations and modifications as fall within the true spirit and scope of the invention.

I claim:

1. The combination of a dumpster container and a containment bag, said dumpster container having a plurality of sidewalls defining a top and a bottom, said bottom being closed, said top being substantially open for accepting bulky materials, said containment bag comprising a bag adapted to fit in said interior of said dumpster container, said containment bag having an exterior surface and an interior surface, a top portion, and a zipper positioned on said top portion, said zipper, when opened, creating an opening on said top portion which is substantially aligned with said open top of said dumpster container, wherein said containment bag further has a series of straps positioned on said exterior surface of said containment bag, where said straps are extendable across said top portion of said containment bag.

2. The combination of a dumpster container and a containment bag according to claim 1 wherein said dumpster container is selected from the set of roll off containers, gondola rail car containers and end dump containers.

3. The combination of a dumpster container and a containment bag according to claim 1 wherein said containment bag further has a lining positioned on said interior surface of said containment bag.

4. The combination of a dumpster container and a containment bag according to claim 3 wherein said lining is waterproof.

5. The combination of a dumpster container and a containment bag according to claim 1 wherein said containment bag is constructed of a woven material.

6. The combination of a dumpster container and a containment bag according to claim 5 wherein woven material is woven polypropylene.

7. The combination of a dumpster container and a containment bag according to claim 3 wherein said lining comprises a polyethylene lining.

8. The combination of a dumpster container and a containment bag according to claim 5 wherein said woven material further has a coating positioned thereon.

9. The combination of a dumpster container and a containment bag according to claim 8 wherein said coating comprises a polyethylene coating.

10. The combination of a dumpster container and a containment bag according to claim 1 further having a series of handles attached to said containment bag and positioned on said bag to attach to said dumpster container.

11. The combination of a dumpster container and a containment bag according to claim 1 wherein said series of handles comprises at least two handles.

12. The combination of a dumpster container and containment bag according to claim 1 wherein said bag side walls form opposing sides and said series of straps, when extending across said top portion, are securable between opposing sides of said containment bag to restrain said flap.

13. A containment bag for use in a dumpster container having a plurality of sidewalls defining a top and a bottom, said bottom being closed, said top being substantially open for accepting bulk materials, said plurality of sidewalls and said bottom defining a dumpster container interior, said containment bag comprising a bag adapted to fit within and line the interior of said dumpster container, said containment bag having a top portion substantially alignable with said top of said dumpster container and having a zipper positioned thereon creating an opening in said top portion when unzipped, and at least four handles attached to said containment bag and positioned on said bag to attach to said dumpster container and thereby support said container bag in said dumpster container when said container bag is positioned in said dumpster container, said zipper, when opened, creates a flap portion on said top portion of said container bag and an opening into the interior of said containment bag, said opening in said containment bag being substantially aligned with said top of said dumpster container when positioned therein and said containment bag further has a series of straps positioned on said exterior surface of said containment bag, where said series of straps are extendable across said top portion of said containment bag.

14. The containment bag according to claim 13 adapted to fit into the interior of a dumpster container selected from the set of roll off containers, gondola rail car containers and end dump containers.

15. The containment bag according to claim 13 wherein said containment bag further has a lining positioned on said interior surface of said containment bag.

16. The containment bag according to claim 13 wherein said containment bag is constructed of a woven material.

17. The combination of a dumpster container and a containment bag according to claim 16 wherein woven material is woven polypropylene.

18. The containment bag according to claim 16 wherein said woven material further has a coating positioned thereon.

19. The combination of a dumpster container and containment bag according to claim 13 wherein said bag side walls form opposing sides and said series of straps, when extending across said top portion, are securable between opposing sides of said containment bag to restrain said flap.

* * * * *